US009366057B1

(12) United States Patent
Ng

(10) Patent No.: US 9,366,057 B1
(45) Date of Patent: Jun. 14, 2016

(54) HIGH SECURITY PADLOCK

(71) Applicant: Vastmax Corporation Limited, Kowloon (HK)

(72) Inventor: William Ng, Hong Kong (CN)

(73) Assignee: Vastmax Corporation Limited, Kowloon, Hong Kong (CN)

( * ) Notice: Subject to any disclaimer, the term of this patent is extended or adjusted under 35 U.S.C. 154(b) by 0 days.

(21) Appl. No.: 14/795,468

(22) Filed: Jul. 9, 2015

Related U.S. Application Data

(63) Continuation-in-part of application No. 14/586,140, filed on Dec. 30, 2014.

(51) Int. Cl.

| | |
|---|---|
| ***E05B 27/06*** | (2006.01) |
| ***E05B 27/00*** | (2006.01) |
| ***E05B 67/24*** | (2006.01) |
| ***E05B 67/02*** | (2006.01) |
| ***E05B 67/38*** | (2006.01) |
| ***E05B 67/28*** | (2006.01) |
| ***E05B 27/08*** | (2006.01) |

(52) U.S. Cl.
CPC ..... *E05B 27/0089* (2013.01); *E05B 27/08* (2013.01); *E05B 67/02* (2013.01); *E05B 67/24* (2013.01); *E05B 67/28* (2013.01); *E05B 67/38* (2013.01)

(58) Field of Classification Search
CPC . E05B 27/00; E05B 27/0017; E05B 27/0085; E05B 27/0089; E05B 27/0092; E05B 27/02; E05B 27/08; E05B 2047/10; E05B 2027/10
USPC ..... 70/20, 31, 35, 38 R, 40, 41, 45, 48, 358
See application file for complete search history.

(56) References Cited

U.S. PATENT DOCUMENTS

| | | | |
|---|---|---|---|
| 1,003,331 | A | 9/1911 | Caldwell |
| 4,196,604 | A | 4/1980 | Vorob |
| 4,282,731 | A | 8/1981 | Taksony |
| 4,358,943 | A | 11/1982 | Ouellet |
| 4,631,941 | A | 12/1986 | Sjunnesson |
| 4,732,023 | A | 3/1988 | Shen |
| 5,000,019 | A | 3/1991 | Foster |
| 5,044,180 | A | 9/1991 | Lebrecht |
| 5,799,519 | A | 9/1998 | Hsiao |
| 5,921,123 | A | 7/1999 | Schwarzkopf et al. |
| 6,519,988 | B1 | 2/2003 | Wu |

(Continued)

OTHER PUBLICATIONS

Apr. 29, 2015—(US) Office Action U.S. Appl. No. 14/586,140.

(Continued)

*Primary Examiner* — Christopher Boswell
(74) *Attorney, Agent, or Firm* — Banner & Witcoff, Ltd.

(57) ABSTRACT

The present invention discloses a padlock, comprising a lock cylinder rotatable between a lock position and an unlock position with rotation of a key. The lock cylinder comprises a keyhole, at least one first through hole extending along a first direction for housing at least one first pin, and at least one second through hole extending along a second direction for housing at least one second pin. When the key is in the keyhole, the teeth of the key are aligned with the at least one first pin and the at least one indentations are aligned with the at least one second pin, allowing the lock cylinder to rotate between the lock position and the unlock position with rotation of the key.

10 Claims, 3 Drawing Sheets

(56) References Cited

U.S. PATENT DOCUMENTS

| | | | |
|---|---|---|---|
| 7,426,842 | B2 | 9/2008 | Hsieh |
| 8,347,660 | B2 | 1/2013 | Guenther |

OTHER PUBLICATIONS

Oct. 23, 2015—(US) Final Office Action U.S. Appl. No. 14/586,140.
Mar 30, 2016 - (US) Non-Final Office Action - U.S. Appl. No. 14/586,140 - filed Dec. 09, 2015 - Inventor William Ng.

HIGH SECURITY PADLOCK

CROSS-REFERENCE TO RELATED APPLICATIONS

This application is a continuation in part of U.S. application Ser. No. 14/586,140, filed Dec. 30, 2014. The entire contents of which are herein incorporated by reference.

TECHNICAL FIELD

The present invention generally relates to a padlock, and particularly relates to a high security padlock.

BACKGROUND

Padlocks are very widely used in storages, and on gates and doors worldwide, due to its convenience and compact structure, etc. However, some unauthorized individuals try to open a padlock using lock-picking tools or by making an unauthorized key. Since the simple internal configuration of a current padlock, opening the padlock with lock-picking tools or the unauthorized key requires little skills and it only takes very short time for the unauthorized individual to open the padlock, and thus the number of the unauthorized use, theft, vandalism, or harm increases rapidly. There is a growing expressed need for a padlock with higher security.

SUMMARY

Objects of the present invention are to provide technical solutions for a padlock with higher security, which obviate at least one of the above-mentioned disadvantages.

According to the present invention, there is provided a padlock, comprising a lock cylinder rotatable between a lock position and an unlock position with rotation of a key, the lock cylinder comprising: a keyhole for receiving the key having a plurality of teeth and at least one indentations; and at least one first through holes extending along a first direction from the keyhole to an outer surface of the lock cylinder for housing at least one first pins, respectively; at least one second through holes extending along a second direction from the keyhole to the outer surface of the lock cylinder for housing at least one second pins, respectively, the second direction being different from the first direction; wherein, when the key is in the keyhole, the teeth of the key are aligned with the at least one first pins such that a proximal end of each first pin contacts with the tooth and a distal end of each first pin is at the outer surface of the lock cylinder, and the at least one indentations are aligned with the at least one second pins such that a proximal end of each second pin contacts with each indentation and a distal end of each second pin is at the outer surface of the lock cylinder, allowing the lock cylinder to rotate between the lock position and the unlock position with rotation of the key.

According to embodiments of the present invention, wherein the padlock further comprises a lock housing comprising: a sleeve shaped to fit with and for receiving the lock cylinder; and a first prong extending outward from the sleeve and having a first recessed portion; wherein when the lock cylinder is in the lock position, the first through holes are aligned with the first recessed portion, the first pins are movable in the first through holes and the first recessed portion, allowing the insertion or removal of the key from the keyhole.

According to embodiments of the present invention, wherein the lock housing further comprises: a second prong extending outward from the sleeve and having a second recessed portion; wherein when the lock cylinder is in the lock position, the second through holes are aligned with the second recessed portion, the second pins are movable in the second through holes and the second recessed portion, allowing the insertion or removal of the key from the keyhole.

According to embodiments of the present invention, wherein when the key is in the keyhole, the teeth of the key are aligned with the at least one first pins and the at least one indentations are aligned with the at least one second pins, and the first pins and the second pins are within the lock cylinder and out of the lock housing, allowing the lock cylinder to rotate relative to the lock housing between the lock position and the unlock position with rotation of the key.

According to embodiments of the present invention, wherein the first direction and/or the second direction extend outward radically from the outer surface of the sleeve, respectively.

According to embodiments of the present invention, wherein an angle formed between the first direction and the second direction is about 90 degrees.

According to embodiments of the present invention, wherein the first prong and/or the second prong extend axially across an entire length of the sleeve.

According to embodiments of the present invention, wherein the first prong and/or the second prong extend axially across part of a length of the sleeve.

According to embodiments of the present invention, wherein the first recessed portion comprises at least one first holes for housing at least one third pins and at least one first springs, respectively; wherein a distal end of each third pin contacts with the respective first spring and a proximal end of each third pin contacts with the lock cylinder.

According to embodiments of the present invention, wherein the second recessed portion comprises at least one second holes for housing at least one fourth pins and at least one second springs, respectively; wherein a distal end of each fourth pin contacts with the respective second spring and a proximal end of each fourth pin contacts with the lock cylinder.

According to embodiments of the present invention, wherein the at least one first through holes are six first through holes; and the at least first pins are six first pins.

According to embodiments of the present invention, wherein the at least one second through holes are one second through hole; and the at least one second pins are one second pin.

According to embodiments of the present invention, wherein the distal end of each first pin and/or second pin is flat headed.

According to embodiments of the present invention, wherein the proximal end of each first pin and/or second pin is tapered.

In conclusion, the embodiments of the present invention provide a high security padlock. The padlock requires the alignment and matching among multiple components of the padlock including two groups of the through holes and pins of the padlock, which significantly reduces the possibility to open the padlock without authorization either with an unauthorized key or with a lock-picking tool, achieves high level of security, provides high durability and reliability and a compact structure.

BRIEF DESCRIPTION OF THE DRAWINGS

The accompanying drawings are included to provide a further understanding of embodiments and constitute a part of this description. The drawings illustrate embodiments and together with the description serve to explain principles of embodiments. The elements of the drawings are not necessarily to scale relative to each other. Similar reference numerals designate corresponding similar parts. It should be expressly understood that the drawings are included for illustrative purposes and do not in any manner limit the scope of the present invention.

DETAILED DESCRIPTION

In the following description, for purposes of explanation rather than limitation, specific details, such as the particular architecture, structure, techniques, etc., are set forth for illustration. However, it will be apparent to those of ordinary skill in the art that other embodiments that depart from these specific details would still be understood to be within the scope of the present invention. Moreover, for the purpose of clarity, detailed descriptions of well-known devices, circuits, and methods are omitted so as not to obscure the description of the present invention. It is to be understood that the features of the various exemplary embodiments described herein may be combined with each other, unless specifically noted otherwise.

According to an embodiment of the present invention, there is provided a padlock 100. According to embodiments of the present invention, the padlock 100 may be made from any suitable materials, for example, stainless steel, bronze, brass, silver, alloys, plastics, composite materials or any combination thereof, and may be configured into any suitable shape, for example, disc, rectangle, square, etc. It is understood that the choice of materials or shapes may vary depending upon the desired protection needs against unauthorized use, theft, vandalism, or harm, desired durability, security level, cost and ease of manufacture.

Figure 1A:
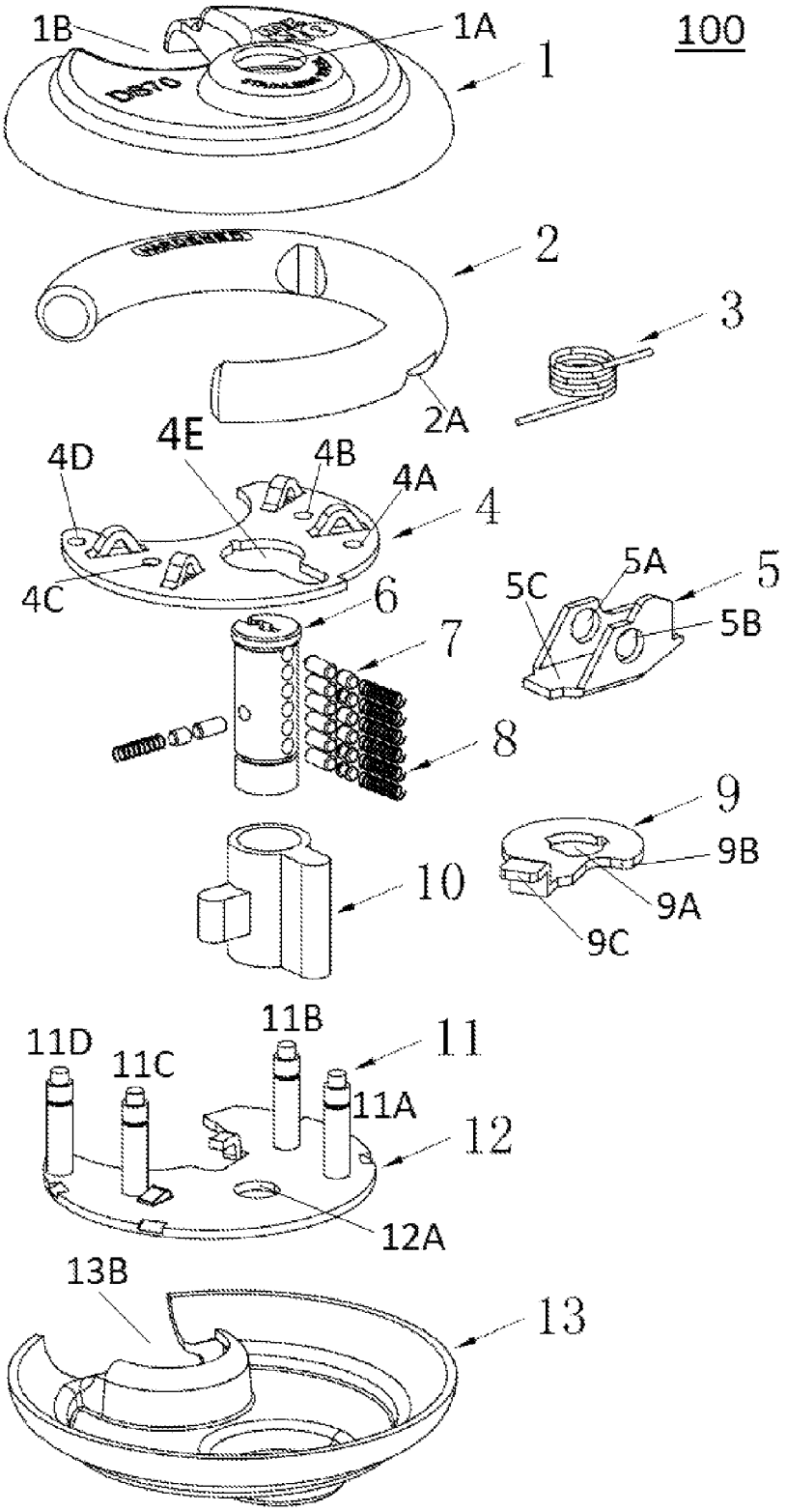
FIG. 1A is a schematic exploded view of the padlock 100 according to an embodiment of the present invention.
Figure 1B:
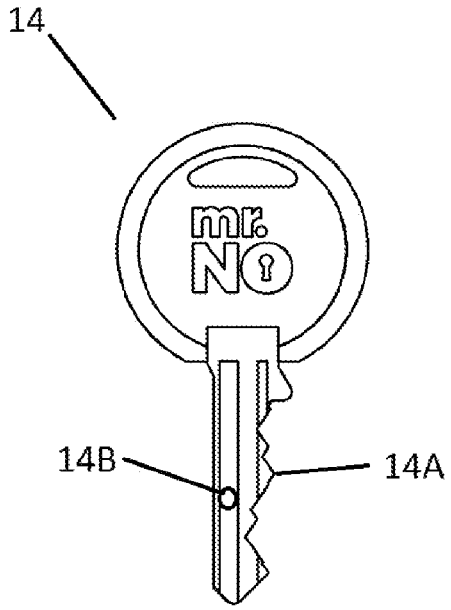
FIG. 1B is a schematic diagram of the key 14 according to an embodiment of the present invention.
Figure 2:
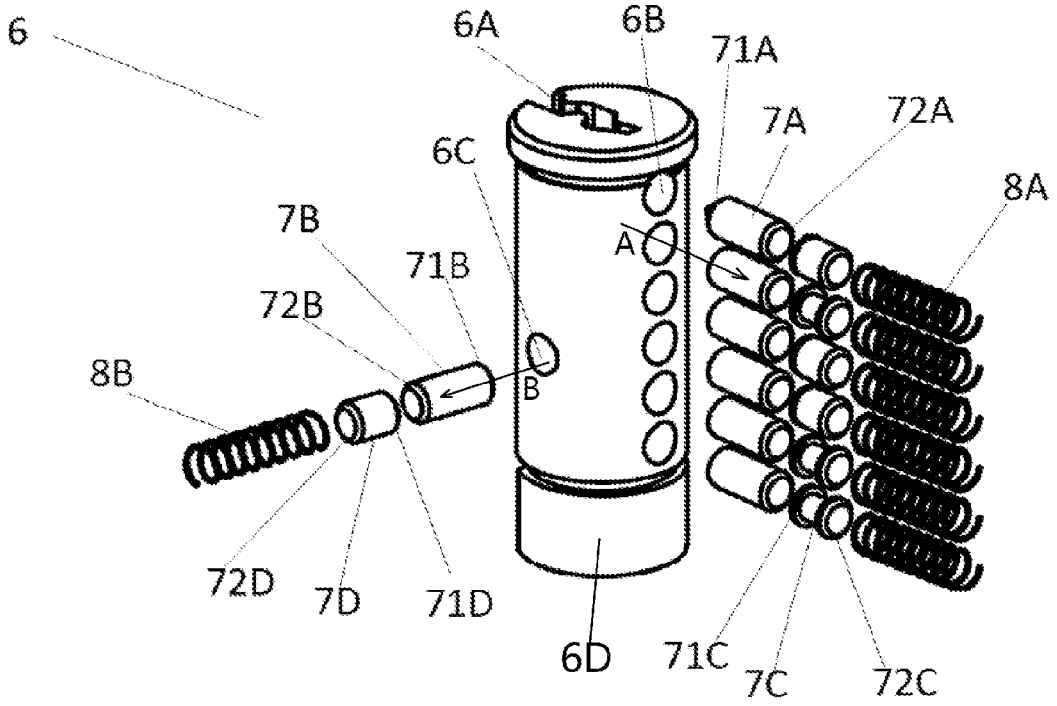
FIG. 2 is a schematic diagram of the lock cylinder according to an embodiment of the present invention.

FIG. 1A is a schematic diagram of the padlock 100 according to an embodiment of the present invention. As shown in FIG. 1A, the padlock 100 comprises a lock cylinder 6. The lock cylinder 6 is rotatable between a lock position and an unlock position with rotation of a key 14 as shown in FIG. 1B. Alternatively, the key 14 may be an authorized key, such as the key made or sold together with the padlock 100, or a key duplicated by the owner of the padlock 100 or any individual authorized by the owner. As shown in FIG. 2, the lock cylinder 6 comprises a keyhole 6A, at least one first through holes 6B and at least one second through holes 6C. The keyhole 6A is for receiving the key 14 having a plurality of teeth 14A and at least one indentations 14B. The at least one first through holes 6B extend along a first direction, as indicated by arrow A, from the keyhole 6A to an outer surface of the lock cylinder 6 for housing at least one first pins 7A, respectively. The at least one second through holes 6C extend along a second direction, as indicated by arrow B, from the keyhole 6A to the outer surface of the lock cylinder 6 for housing at least one second pins 7B, respectively, the second direction B being different from the first direction A. When the key 14 is in the keyhole 6A, the teeth 14A of the key 14 are aligned with the at least one first pins 7A, and a proximal end 71A of each first pin 7A contacts with the tooth 14A and a distal end 72A of each first pin 7A is at the outer surface of the lock cylinder 6. Similarly, when the key 14 is in the keyhole 6A, the at least one indentations 14B are aligned with the at least one second pins 6C, a proximal end 71B of each second pin 7B contacts with each indentation 14B and a distal end 72B of each second pin 7B is at the outer surface of the lock cylinder 6. The alignment between the teeth 14A and the at least one first pins 7A and the alignment between the at least one indentations 14B and the at least one second pins 6C allow the lock cylinder 6 to rotate between the lock position and the unlock position with rotation of the key 14. Such configuration of the padlock 100, according to an embodiment of the present invention, significantly improves the level of security, since the rotation of the key 14 requires both the alignment between each tooth 14A of the key 14 and the respective first pin 7A and the alignment between each indentation 14B and the respective second pin 7B.

According to a further embodiment of the present invention, in some cases, an unauthorized individual, such as a theft or illegal intruder, makes an unauthorized key trying to open the padlock 100 for theft, intrusion or harm, etc. However, due to the high security configuration of the padlock 100, including the two groups of through holes 6B, 6C and the two groups of pins 7A, 7B, in order to open the padlock 100, the unauthorized key has to be made with teeth and indentations respectively which can align with and match the two groups of through holes 6B, 6C and the two groups of pins 7A, 7B of the padlock 100, which requires the number and/or size of teeth or indentations, the position or orientation of each tooth or indentation, and/or the relative position or orientation between the teeth and/or indentations of the unauthorized key to be the same as those of the key 14. Especially, for the padlock 100, the arrangement of two groups of through holes 6B, 6C and the two groups of pins 7A, 7B is not visible from its appearance. It is extremely difficult to make the unauthorized key with teeth and indentations respectively aligned with and matching the two groups of through holes 6B, 6C and the two groups of pins 7A, 7B of the padlock 100, and thus the security of the padlock 100 is highly improved.

According to a further embodiment of the present invention, when the unauthorized key is forced into the keyhole 6A, some of the teeth of the unauthorized key may be not aligned with the at least one first pins 7A, some of the indentations are not aligned with the at least one second pins 7B, and/or the length of the at least one first pins 7A and/or the at least second pins 7B does not match the size of the teeth and/or indentations the unauthorized key, such that some of the first pins 7A and/or the second pins 7B are in-between the lock cylinder 6 and the lock housing 10, preventing the lock cylinder 6 from rotating relative to the lock housing 10.

According to a further embodiment of the present invention, in some other cases, the unauthorized individual tries to open the padlock 100 with a lock-picking tool, instead of making the unauthorized key. It is also difficult to set up the lock-picking tool to align with and match the two groups of through holes 6B, 6C and the two groups of pins 7A, 7B of the padlock 100, considering the number, size, absolute position and/or orientation, and/or relative position and/or orientation of the two groups of through holes 6B, 6C and the two groups of pins 7A, 7B. Thus, it is very difficult and requires much higher skills and more time to open the padlock 100 with the lock-picking tool. Additionally, most of the currently available lock-picking tools are designed for those locks with one groups of through holes or pins arranged in one direction, which even lower the possibility to open the padlock 100 without authorization.

Figure 3:
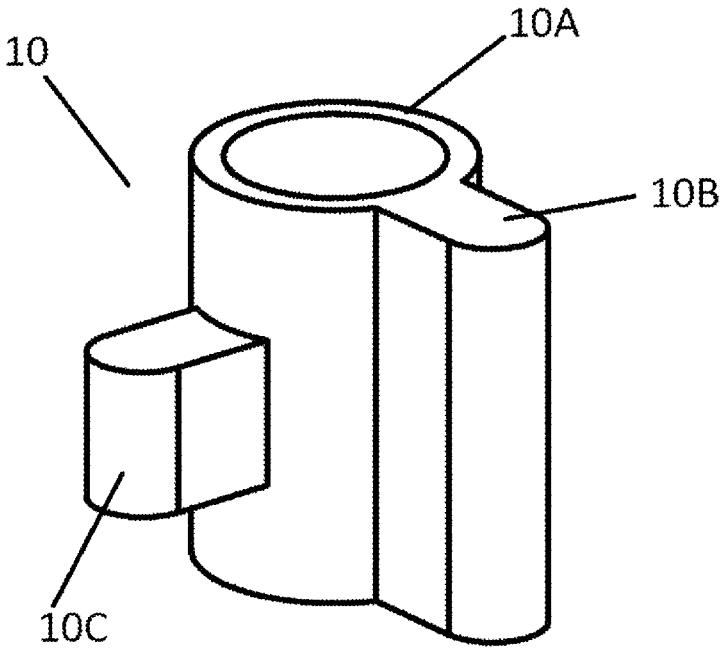
FIG. 3 is a schematic diagram of the lock housing according to an embodiment of the present invention.

According to embodiments of the present invention, the padlock 100 further comprises a lock housing 10. As shown in FIG. 3, the lock housing 10 comprises a sleeve 10A and a first prong 10B. The sleeve 10A is shaped to fit with and for receiving the lock cylinder 6, so that the lock cylinder 6 is rotatable within the sleeve 10A between the lock position and the unlock position. Alternatively, the outer surface of the lock cylinder 6 is in close contact with an inner surface of the sleeve 10A. The first prong 10B extends outward from the sleeve 10A and has a first recessed portion (not shown); wherein when the lock cylinder 6 is in the lock position, the first through holes 6B are aligned with the first recessed portion which provides additional room for the at least one first pins 7A, so that the at least one first pins 7A are movable in the space formed by the through holes 6B and the first recessed portion. When a user is inserting or unplugging the key 14, the tooth 14A of the key 14 pushes the proximal end 71A of each first pin 7A outwards through the respective first through holes 6B into the first recessed portion, providing sufficient room for the key 14 to pass through the keyhole 6A and thus allowing the insertion or removal of the key 14.

According to a further embodiment of the present invention, when the key 14 is in the keyhole 6A but not aligned to the lock position, the at least one first through holes 6B are not aligned with the first prong 10B. The proximal end 71A of each first pin 7A contacts with the tooth 14A of the key 14, and the distal end 72A of each first pin 7A is at the outer surface of the lock cylinder 6 and reaches the inner surface of the sleeve 10A. If a user is trying to unplug the key 14, the tooth 14A of the key 14 tends to push the proximal end 71A of each first pin 7A outwards. However, when the key 14 in the keyhole 6A is not aligned to the lock position, the distal end 72A of the first pin 7A is stopped by the inner surface of the sleeve 10A, resulting in that the first pin 7A is not movable in the through hole 6B which prevents the key 14 from being removed out of the keyhole 6A.

According to embodiments of the present invention, wherein the lock housing 10 further comprises a second prong 10C. As shown in FIG. 3, the second prong 10C extends outward from the sleeve 10A and has a second recessed portion (not shown); wherein when the lock cylinder 6 is in the lock position, the second through holes 6C are aligned with the second recessed portion, which provides additional room for the at least one second pins 7B, so that the at least one second pins 7B are movable in the space formed by the second through holes 6C and the second recessed portion. When a user is inserting or unplugging the key 14, the key 14 pushes the proximal end 71B of each second pin 7B outwards through the respective second through hole 6C into the second recessed portion, providing sufficient room for the key 14 to pass through the key hole 6A and thus allowing the insertion or removal of the key 14.

According to a further embodiment of the present invention, when the key 14 is in the keyhole 6A but not aligned to the lock position, the at least one second through holes 6C are not aligned with the second prong 10C. The proximal end 71B of each second pin 7B contacts with the indentation 14B of the key 14, and the distal end 72B of each second pin 7B is at the outer surface of the lock cylinder 6 and reaches the inner surface of the sleeve 10A. If a user is trying to unplug the key 14, the second pin tends to move out of the indentation 14B of the key 14 which tends to push the proximal end 71B of each second pin 7B outwards. However, the distal end 72B of the second pin 7B is stopped by the inner surface of the sleeve 10A, resulting in that the second pin 7B is not movable in the through hole 6C which prevents the key 14 from being removed out of the keyhole 6A.

Optionally, the sleeve 10A, the first prong 10B and/or the second prong 10C may be formed in an integrated piece. Alternatively, the sleeve 10A, the first prong 10B and/or the second prong 10C may be formed separately and connected together mechanically, for example, by welding, adhesive, or fasteners, etc.

According to embodiments of the present invention, referring to FIG. 1, alternatively, the padlock 100 may further comprise an upper chassis 4 and a bottom chassis 12. The lock cylinder 6 and the lock housing 10 are placed between and held by the upper chassis 4 and the bottom chassis 12. The bottom chassis 12 has an opening 12A allowing a lower end 6D of the lock cylinder 6 to pass through and a plurality of rivets 11A-11D. The upper chassis 4 has a plurality of holes 4A-4D for receiving the rivets and an opening 4E shaped to fit the cross section of the upper portion of the lock housing 10 comprising the sleeve 10A and the first and second recessed portions 10B, 10C. When the lock cylinder 6 rotates between the lock position and the unlock position, the lock housing 10 is fixed relative to the upper chassis 4 and the bottom chassis 12. It is understood that the terms "upper" and "bottom" are merely relative and do not limit the positioning of the padlock to any particular orientation.

According to a further embodiment of the present invention, the padlock 100 may further comprise a guiding bracket 5 and a latch 9 disposed between the upper chassis 4 and the bottom chassis 12. The guiding bracket 5 comprises an upper plate 5A, a lower plate 5B and a middle plate 5C. The upper plate 5A and lower plate 5B are parallel to each other and each comprises a hole for receiving the rivet 11B of the bottom chassis 12. The middle plate 5C is configured to be between and perpendicular to the upper plate 5A and the lower plate 5B. A spring 3 is disposed around the rivet 11B between the upper plate 5A and lower plate 5B and aligned with the holes of the upper plate 5A and lower plate 5B for receiving the same rivet 11B. One end of the spring 3 is placed against the middle plate 5C and other end is placed against the rivet 11A. Such configuration of the spring 3 generates a tension force in the spring 3, causing the guiding bracket 5 to tend to move clockwise around the rivet 11B. The latch 9 comprises an opening 9A which is shaped to fit the lower end 6D of the lock cylinder 6 and is aligned with the opening 12A of the bottom chassis, a peripheral edge 9B and a projection 9C extending outwards and upwards. When the lock cylinder 6 rotates between the lock position and the unlock position, the latch 9 rotates together with the lock cylinder 6 since the opening 9A is shaped to fit the shape of the lower end 6D of the lock cylinder 6. The peripheral edge 9B of the latch 9 moves against and is pushed by the edge of the lower plate 5B of the guiding bracket 5, due to the tendency of the guiding bracket 5 moving clockwise given by the spring 3. The interaction between the latch 9 and the guiding bracket 5 provides the lock cylinder 6 with guidance for a smooth rotation movement.

According to a further embodiment of the present invention, the padlock 100 may further comprise a shackle 2 that may be passed through an opening, such as a chain link, or hasp staple. The shackle 2 comprises an indentation 2A for engaging with the projection 9C of the latch 9. When the lock cylinder 6 rotates with the key 14 between the lock position and the unlock position, the shackle 2 rotates together with the latch 9 and the lock cylinder 6.

According to a further embodiment of the present invention, the padlock 100 may further comprise an upper casing 1 and a bottom casing 13 for accommodates the components of the padlock 100 as described above. The upper casing 1 comprises an opening 1A shaped to fit an upper end of the lock cylinder 6, so that the key 14 may be plugged in or removed from the lock cylinder through the opening 1A. The upper casing 1 and the bottom casing 13 comprises notches 1B and 13B, respectively, which are aligned with each other for receiving the chain link, hasp staple or the like. When the lock cylinder 6 rotates to the lock position, the shackle 2 is positioned across the notches 1B and 13B with one end of the shackle 2 stopped by the rivet 11D. When the lock cylinder 6 rotates to the unlock position, the shackle 2 is configured to move out of the notches 1B and 13B and be enclosed entirely within the upper casing 1 and the bottom casing 13, with the other end of the shackle 2 stopped by the rivet 11D.

According to embodiments of the present invention, wherein when the key 14 is in the keyhole 6A, the teeth 14A of the key 14 are aligned with the at least one first pins 7A and the at least one indentations 14B are aligned with the at least one second pins 7B. The at least one first pins 7A and the at least second pins 7B are sized to match the teeth 14A and indentations 14B of the key 14, respectively, such that the first pins 7A and the second pins 7B are within the lock cylinder 6 and out of the lock housing 10, allowing the lock cylinder 6 to rotate relative to the lock housing 10 between the lock position and the unlock position with rotation of the key 14. Such configuration of the padlock 100, including the first and second through holes 6B, 6C, the first and second pins 7A, 7B, and the first and second recess portion 10B, 10C, significantly improves the level of security, since the rotation of the key 14 requires both the alignment and matching between each tooth 14A and indentation 14B of the key 14 and the first and second through holes 6B, 6C, the first and second pins 7A, 7B, and the first and second recess portion 10B, 10C of the padlock 100.

According to a further embodiment of the present invention, when an unauthorized key is forced into the keyhole 6A, the arrangement of the teeth and/or indentations of the unauthorized key may result in that some of the teeth of the unauthorized key are not aligned with the at least one first pins 7A, some of the indentations are not aligned with the at least one second pins 7B, and/or the size of the teeth and/or indentations of the unauthorized key does not match the size of the at least one first pins 7A and/or the at least one second pins 7B, such that some of the first pins 7A and/or the second pins 7B are in-between the lock cylinder 6 and the lock housing 10, preventing the lock cylinder 6 from rotating relative to the lock housing 10.

According to embodiments of the present invention, wherein the first direction A and/or the second direction B extend outward radically from the outer surface of the sleeve 10A, respectively. Alternatively, the first direction A and/or the second direction B may be biased from the radical direction of the sleeve 10A.

According to embodiments of the present invention, an angle formed between the first direction A and the second direction B is about 90 degrees. The at least one first through holes 6B or the at least one first pins 7A are oriented perpendicularly to the at least one second through holes 6C or the at least one second pins 7B. Accordingly, the teeth 14A of the key 14 are oriented perpendicularly to the at least one indentations, such that when key 14 is in the keyhole 6A, the teeth 14A of the key 14 are aligned with the at least one first through holes 6B or the at least one first pins 7A, and the at least one indentations 14B are aligned with the at least one second through holes 6C or the at least one second pins 7B, allowing the rotation of the key 14 between the lock position and the unlock position. Alternatively, the first direction A and the second direction B may form a different angle depending on the desired needs.

According to embodiments of the present invention, the first prong 10B and/or the second prong 10C extend axially across an entire length of the sleeve 10A. Alternatively, one of the prongs, such as the first prong 10B, extends axially across an entire length of the sleeve 10A, as shown in FIG. 3. Alternatively, both of the prongs extend axially across an entire length of the sleeve 10A. Such configuration, where the first prong 10B and/or the second prong 10C extend axially across an entire length of the sleeve 10A, enhances the mechanical strength of the joints between the sleeve 10A and the first prong 10B and/or the second prong 10C, and improves the durability and security of the padlock 100.

According to embodiments of the present invention, the first prong 10B and/or the second prong 10C extend axially across part of a length of the sleeve 10A. Alternatively, one of the prongs, such as the second prong 10C, extends axially across part of a length of the sleeve 10A, as shown in FIG. 3. Alternatively, both of the prongs extend axially across part of a length of the sleeve 10A. Such configuration, where the first prong 10B and/or the second prong 10C extend axially across part of a length of the sleeve 10A, enables the structure of the lock housing 10 to be more compact and sparing more room for other components of the padlock 100, reduces the amount of the raw material needed and thus lowers the costs.

According to embodiments of the present invention, the first recessed portion 10B comprises at least one first holes (not shown) for housing at least one third pins 7C and at least one first springs 8A, respectively, as shown in FIG. 2; wherein a distal end 72C of each third pin 7C contacts with the respective first spring 8A and a proximal end 71C of each third pin 7C contacts with the lock cylinder 6. When the key 14 is aligned to the lock position, the teeth 14A of the key 14 are aligned with the first prong 10B, the proximal end 71A of each first pin 7A contacts with the tooth 14A, and the distal end 72A of the first pin 7A contacts with the proximal end 71C of the third pin 7C. Here, the first pins 7A are within the lock cylinder 6 with their distal ends 72A on the outer surface of the lock cylinder 6, and the third pins 7C are within the first prong 10B of the lock housing 10 with their proximal ends 71C on the inner surface of the sleeve 10A, allowing the rotation of the key 14.

According to embodiments of the present invention, the second recessed portion 10C comprises at least one second holes (not shown) for housing at least one fourth pins 7D and at least one second springs 8B, respectively, as shown in FIG. 2; wherein a distal end 72D of each fourth pin 7D contacts with the respective second spring 8B and a proximal end 71D of each fourth pin 7D contacts with the lock cylinder 6. When the key 14 is aligned to the lock position, the at least one indentations 14B of the key 14 are aligned with the second prong 10C, the proximal end 71B of each second pin 7B contacts with the indentation 14B, and the distal end 72B of the second pin 7B contacts with the proximal end 71D of the fourth pin 7D. Here, the second pins 7B are within the lock cylinder 6 with their distal ends 72B on the outer surface of the lock cylinder 6, and the fourth pins 7D are within the second prong 10C of the lock housing 10 with their proximal ends 71D on the inner surface of the sleeve 10A, allowing the rotation of the key 14. Such configuration of the padlock 100, including the first and second through holes 6B, 6C, the first, second, third and fourth pins 7A-7D, and the first and second recess portion 10B, 10C, significantly improves the level of security, since the rotation of the key 14 requires both the alignment and matching among each tooth 14A and indentation 14B of the key 14, the first and second through holes 6B, 6C, the first, second, third and fourth pins 7A-7D, and the first and second recess portion 10B, 10C of the padlock 100.

According to a further embodiment of the present invention, when a user is trying to insert or unplug the key 14, the key 14 tends to push the proximal end 71A of each first pin 7A and the proximal end 71B of each second pin 7B outwards. The distal end 72A of each first pin 7A pushes the proximal end 71C of each third pin 7C, and the distal end 72C pushes the respective first springs 8A; and the distal end 72B of each second pin 7B pushes the proximal end 71D of each fourth pin 7D, and the distal end 72D pushes the respective second springs 8B. The first and second springs 8A and 8B are compressed by the force from the distal end 72C of each third pins 7C and the distal end 7D of each fourth pin 72D, respectively, providing additional room for the pins 7A-7D, so that these pins are movable in the space formed by the through holes 6B and the first recessed portion 10B and the space formed by the through holes 6C and the second recessed portion 10C. When a user is inserting or unplugging the key 14, the tooth 14A of the key pushes the proximal end 71A of each first pin 7A outwards through the at least through holes 6B into the first recessed portion 10B, and the second pin 7B tends to move out of the indentation 14B of the key 14 and is pushed through the second through holes 6C into the second recessed portion 10C, providing sufficient room for the key 14 to pass through the keyhole 6A and thus allowing the insertion or removal of the key 14.

According to a further embodiment of the present invention, when an unauthorized key is forced into the keyhole 6A, the arrangement of the teeth and/or indentations of the unauthorized key may result in that some of the teeth of the unauthorized key are not aligned with some of the first pins 7A and third pins 7C, some of the indentations are not aligned with the second pins 7B and fourth pins 7D, and/or the size of the teeth and/or indentations of the unauthorized key does not match the size of the first, second, third and/or fourth pins 7A-7D, such that some of the pins 7A-7D are in-between the lock cylinder 6 and the lock housing 10, preventing the lock cylinder 6 from rotating relative to the lock housing 10.

Alternatively, the first recessed portion and the second recessed portion each may comprise other parts which is elastic and can be deformed or compressed upon pressure to provide additional room for the removal of the key, for example, rubber columns, etc.

According to embodiments of the present invention, the at least one first through holes 6B are six first through holes; and the at least first pins 7A are six first pins. Such configuration of the padlock 100 with six first through holes 6B requires much higher skills and more time to make an unauthorized key or use the lock-picking tool to open the padlock 100, increasing the difficulty and time needed for a theft, unauthorized use, vandalism, or harm and thus lowering the crime rate. Additionally, most of the currently available lock-picking tools are designed for those locks with two to four through holes or pins arranged in one direction, which even lower possibility to open the padlock without authorization and thus increasing the level of security of the padlock 100.

According to embodiments of the present invention, the at least one second through holes 6C are one second through hole; and the at least one second pins 7B are one second pin. Such configuration of the padlock 100 achieves high level of security, and meanwhile simplifies the structure of the padlock 100 and thus lowers costs.

According to embodiments of the present invention, the distal end of each first pin 7A and/or second pin 7B is flat headed. When a user is trying to insert or unplug the key 14, the tooth 14A of the key tends to push the proximal end 71A of each first pin 7A outwards and the second pin 7B tends to move out of the indentation 14B. The distal end 72A of each first pin 7A pushes the proximal end 71C of each third pin 7C, and the distal end 72B of each second pin 7B pushes the proximal end 71D of each fourth pin 7D, to exert pushing force to the springs 8A or 8B to compress the springs 8A and 8B, providing additional room for the pins 7A-7D, so that the first pins 7A and the third pins 7C are movable in the space formed by the first through holes 6B and the first recessed portion 10B, and the second pins 7B and the fourth pins 7D are movable in the space formed by the second through holes 6C and the second recessed portion 10C. The flat headed distal end of each first pin 7A and/or second pin 7B enables the pushing force to be applied steadily to the proximal end of each third pin 7C and/or fourth pin 7D, respectively, and thus increases security and reliability of the padlock 100.

According to embodiments of the present invention, the proximal end of each first pin 7A and/or second pin 7B is tapered. When the key 14 is aligned with the first prong 10B, a user is inserting or unplugging the key 14, the key 14 is movable from the keyhole 6A. The tapered proximal end of each first pin 7A contacting the teeth 14A of the key 14 and the second pin 7B moving out of the indentation 14B facilitates a smooth and easy inserting or removal movement of the key 14, reduces the chances that the key 14 is damaged during insertion or removal from the keyhole and thus improves the durability of the padlock 100.

In conclusion, the embodiments of the present invention provide a high security padlock. The padlock requires the alignment and matching among multiple components of the padlock including two groups of the through holes and pins of the padlock, which significantly reduces the possibility to open the padlock without authorization either with an unauthorized key or with a lock-picking tool, achieves high level of security, provides high durability and reliability and a compact structure.

It should be noted that the aforesaid embodiments are exemplary rather than limiting the present invention, substitute an alternative embodiments may be designed by those skilled in the art without departing from the scope of the claims enclosed. The word "include" does not exclude elements or steps which are present but not listed in the claims. The word "a" or "an" preceding the elements does not exclude the presence of a plurality of such elements. In the apparatus claims that list several components, several ones among these components can be specifically embodied in the same hardware item. The use of such words as first, second, third does not represent any order, which can be simply explained as names.

I claim:

1. A padlock, comprising a lock cylinder rotatable between a lock position and an unlock position with rotation of a key, the lock cylinder comprising:

a keyhole for receiving the key having a plurality of teeth and at least one indentation; and at least one first through hole extending along a first direction from the keyhole to an outer surface of the lock cylinder for housing at least one first pin, respectively; and at least one second through hole extending along a second direction from the keyhole to the outer surface of the lock cylinder for housing at least one second pin, respectively, the second direction being different from the first direction, wherein, when the key is in the keyhole, the teeth of the key are aligned with the at least one first pin such that a proximal end of each first pin contacts with a corresponding tooth and a distal end of each first pin is at the outer surface of the lock cylinder, and the at least one indentation is aligned with the at least one second pin such that a proximal end of each second pin contacts with a corresponding indentation and a distal end of each second pin is at the outer surface of the lock cylinder, allowing the lock cylinder to rotate between the lock position and the unlock position with rotation of the key, wherein the padlock further comprises a lock housing comprising:

a sleeve shaped to fit with and for receiving the lock cylinder; and a first prong extending outward from the sleeve and having a first recessed portion; wherein when the lock cylinder is in the lock position, the at least one first through hole is aligned with the first recessed portion, the at least one first pin is movable in the at least one first through hole and the first recessed portion, allowing the insertion or removal of the key from the keyhole, wherein the lock housing further comprises:

a second prong extending outward from the sleeve and having a second recessed portion; wherein when the lock cylinder is in the lock position, the at least one second through hole is aligned with the second recessed portion, the at least one second pin is movable in the at least one second through hole and the second recessed portion, allowing the insertion or removal of the key from the keyhole, and wherein one of the first prong and the second prong extends axially across an entire length of the sleeve and the other one of the first prong and the second prong extends axially across a part of, and less than the entire length of, the sleeve.

2. The padlock according to claim 1, wherein when the key is in the keyhole, the teeth of the key are aligned with the at least one first pin and the at least one indentation is aligned with the at least one second pin, and the at least one first pin and the at least one second pin are within the lock cylinder and out of the lock housing, allowing the lock cylinder to rotate relative to the lock housing between the lock position and the unlock position with rotation of the key.

3. The padlock according to claim 1, wherein the first direction and/or the second direction extend outward radically from the outer surface of the sleeve, respectively.

4. The padlock according to claim 1, wherein an angle formed between the first direction and the second direction is about 90 degrees.

5. The padlock according to claim 1, wherein the first recessed portion comprises at least one first hole for housing at least one third pin and at least one first spring, respectively, and wherein a distal end of each third pin contacts with the respective first spring and a proximal end of each third pin contacts with the lock cylinder.

6. The padlock according to claim 1, wherein the second recessed portion comprises at least one second hole for housing at least one fourth pin and at least one second spring, respectively, and wherein a distal end of each fourth pin contacts with the respective second spring and a proximal end of each fourth pin contacts with the lock cylinder.

7. The padlock according to claim 1, wherein the at least one first through hole comprises six first through holes; and the at least one first pin comprises six first pins.

8. The padlock according to claim 1, wherein the at least one second through hole comprises one second through hole; and the at least one second pin comprises one second pin.

9. The padlock according to claim 1, wherein the distal end of each first pin and/or second pin is flat headed.

10. The padlock according to claim 1, wherein the proximal end of each first pin and/or second pin is tapered.

* * * * *